US009291968B2

(12) United States Patent
Tamada et al.

(10) Patent No.: US 9,291,968 B2
(45) Date of Patent: Mar. 22, 2016

(54) IMAGE FORMING APPARATUS

(71) Applicant: Konica Minolta, Inc., Chiyoda-ku (JP)

(72) Inventors: Takeshi Tamada, Aichi-ken (JP); Satoshi Ogata, Tokyo (JP); Kenji Izumiya, Tokyo (JP); Masatoshi Hitaka, Aichi-ken (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/560,327

(22) Filed: Dec. 4, 2014

(65) Prior Publication Data

US 2015/0160595 A1 Jun. 11, 2015

(30) Foreign Application Priority Data

Dec. 5, 2013 (JP) ..... 2013-252210

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2035; G03G 15/2017; G03G 15/2064; G03G 15/206
USPC ..... 399/329
See application file for complete search history.

(56) References Cited

U.S. PATENT DOCUMENTS

2012/0041662 A1* 2/2012 Vollert ..... B60T 8/4068 701/70

FOREIGN PATENT DOCUMENTS

| | | | |
|---|---|---|---|
| JP | 2006-58758 | A | 3/2006 |
| JP | 2006-256708 | A | 9/2006 |
| JP | 2007-183682 | A | 7/2007 |

OTHER PUBLICATIONS

Machine translation of Uchiumi JP 2007-183682, publication date: Jul. 19, 2007.*

* cited by examiner

*Primary Examiner* — Walter L Lindsay, Jr.
*Assistant Examiner* — Frederick Wenderoth
(74) *Attorney, Agent, or Firm* — Buchanan Ingersoll & Rooney PC

(57) ABSTRACT

An image forming apparatus performs a serviceman call detection mode during its idling time. In this time, a control portion controls upper and lower pressuring rollers to be clamped, controls a driving motor, and controls a change-over mechanism to switch a braking motor off. A torque detection portion detects a torque value Y of the driving motor at this time. The control portion then controls the upper and lower pressuring rollers to be clamped, controls the driving motor, and controls the change-over mechanism to switch the braking motor on. The torque detection portion detects a torque value Z of the driving motor at this time. The control portion subtracts the torque value Y from the torque value Z to calculate a difference value. The control portion determines that the braking motor is broken down when the difference value does not exceed the threshold value.

5 Claims, 4 Drawing Sheets

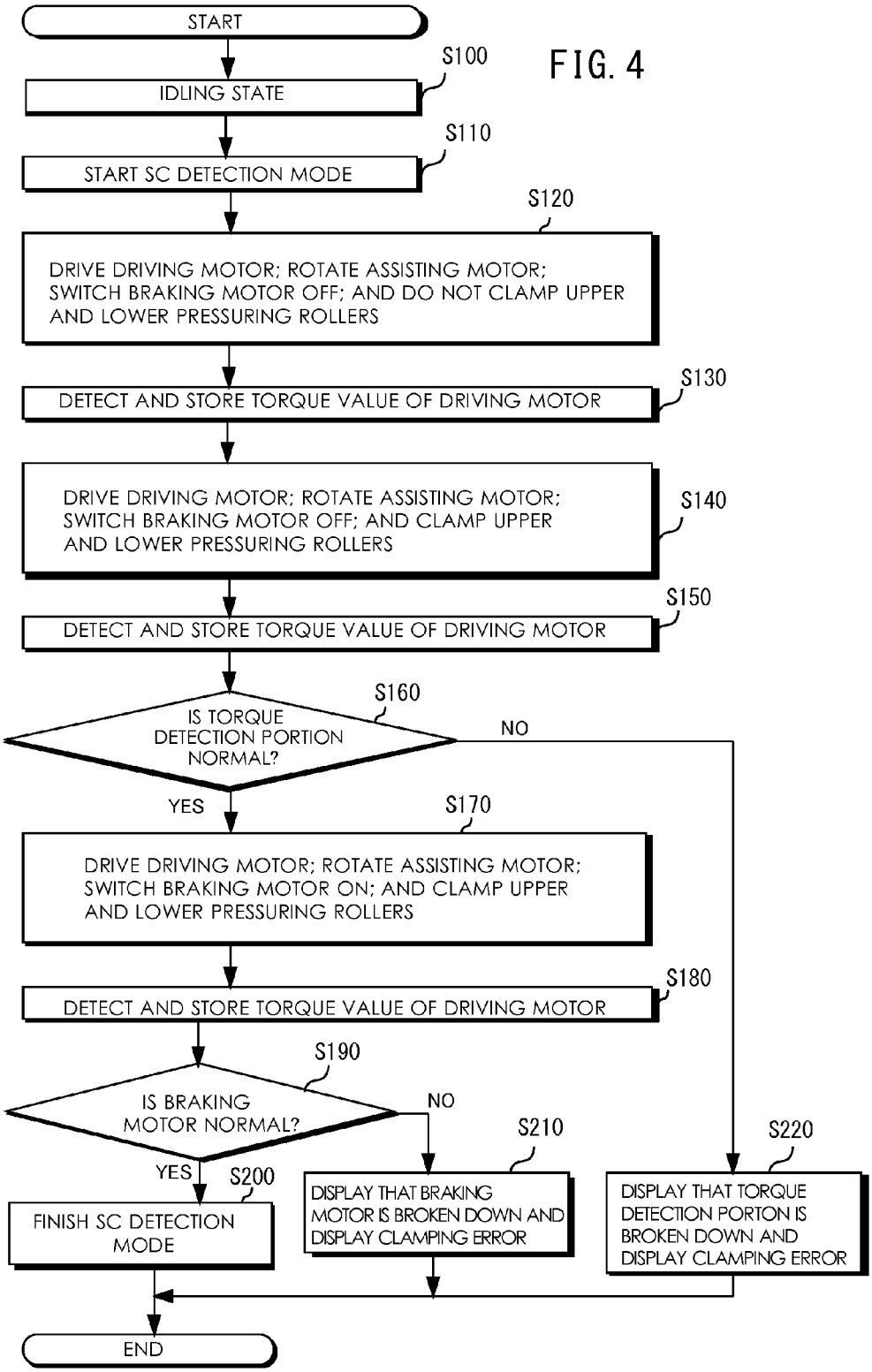
FIG. 4
START
S100
IDLING STATE
S110
START SC DETECTION MODE
S120
DRIVE DRIVING MOTOR; ROTATE ASSISTING MOTOR; SWITCH BRAKING MOTOR OFF; AND DO NOT CLAMP UPPER AND LOWER PRESSURING ROLLERS
S130
DETECT AND STORE TORQUE VALUE OF DRIVING MOTOR
S140
DRIVE DRIVING MOTOR; ROTATE ASSISTING MOTOR; SWITCH BRAKING MOTOR OFF; AND CLAMP UPPER AND LOWER PRESSURING ROLLERS
S150
DETECT AND STORE TORQUE VALUE OF DRIVING MOTOR
S160
IS TORQUE DETECTION PORTION NORMAL?
NO
YES
S170
DRIVE DRIVING MOTOR; ROTATE ASSISTING MOTOR; SWITCH BRAKING MOTOR ON; AND CLAMP UPPER AND LOWER PRESSURING ROLLERS
S180
DETECT AND STORE TORQUE VALUE OF DRIVING MOTOR
S190
IS BRAKING MOTOR NORMAL?
NO
YES
S200
FINISH SC DETECTION MODE
S210
DISPLAY THAT BRAKING MOTOR IS BROKEN DOWN AND DISPLAY CLAMPING ERROR
S220
DISPLAY THAT TORQUE DETECTION PORTON IS BROKEN DOWN AND DISPLAY CLAMPING ERROR
END

IMAGE FORMING APPARATUS

CROSS REFERENCE TO RELATED APPLICATION

The present invention contains subject matter related to Japanese Patent Application No. JP 2013-252210 filed in the Japanese Patent Office on Dec. 5, 2013, the entire contents of which being incorporated herein by reference.

BACKGROUND OF THE INVENTION

1. Technical Field

The present invention relates to an electrographic image forming apparatus such as a printer, a copier, a facsimile and the like.

2. Background Art

In general, the electrographic image forming apparatus includes a fixing portion for fixing a toner image on a sheet of paper. Such a fixing portion has a heating roller having any heating source built-in, an upper pressuring roller, an endless fixing belt that stretches the heating roller and the upper pressuring roller, and a lower pressuring roller that is arranged to face the upper pressuring roller (Heating Belt System).

In the image forming apparatus, when performing a fixing process, the upper and lower pressuring rollers are clamped to form a fixing nip portion. This nip portion allows a toner image to be fixed on the sheet of paper on which an image forming portion has transferred the toner image, by passing the sheet of paper through the nip portion to be heated and pressurized. In addition, although the heating belt system has been described in the above description, the fixing portion can adopt a heating roller system in which the upper pressurizing roller has a heating source built-in and the upper pressuring roller itself is formed as a heating portion.

By the way, during the fixing process of the fixing portion, a toner-image-supporting portion of the sheet of paper, in which the toner image has been not yet fixed, directly contacts the fixing belt and the upper pressurizing roller (hereinafter, a case where the fixing belt is used will be described.) In this moment, wax oozed out of the toner image adheres to a side of fixing belt so that a latent image by the wax can be formed on the side of fixing belt. In such a condition, when a next sheet of paper is conveyed, the wax may be transferred to the image formed on this sheet of paper. Specifically, when fixing the toner forming the image on the next sheet of paper, the wax adhered to the fixing belt or the like is moved to the next sheet of paper. This enables to appear on the next sheet of paper a phenomenon in which gloss unevenness may appear on a portion in the next sheet of paper to which a large amount of wax adhere and a portion in the next sheet of paper to which a small amount of wax adheres (hereinafter, referred to as "gloss memory"). This gloss memory can cause image quality to be deteriorated.

Accordingly, in order to prevent the image quality from being deteriorated by the gloss memory, it is a known technology that the roller and the sheet of paper are slipped by generating any braking force to a direction of obstructing the rotation of the upper or lower pressuring roller to inhibit the wax from adhering to the side of fixing belt. For example, the following examples as the technology for applying the braking force to the roller constituting the fixing portion will be given.

Japanese Patent Application Publication No. 2007-183682 discloses a fixing mechanism which has a slide bearing for applying a braking force to control a speed-up phenomenon of the rotation before a rear end of the sheet of paper is passed through the fixing nip portion of the heating roll for fixing.

Japanese Patent Application Publication No. 2006-256708 discloses an image forming apparatus in which a brake roller applies a predetermined rotation load to the pressuring roller to slow down a rotation speed of the pressuring roller so that a load for allowing the speed of the sheet of paper which is apart from the heating roller in the double sheets of paper to slow down can be applied.

Japanese Patent Application Publication No. 2006-58758 discloses an image forming apparatus which has a braking member utilizing electroviscous fluid in which its viscosity varies based on a load variation to control a braking force of this braking member based on the load variation.

SUMMARY OF THE INVENTION

Issues to be Addressed by the Invention

However, in a case where a braking force generation portion for generating a braking force is broken down in the image forming apparatuses in the above past methods of eliminating the gloss memory by applying any braking force, it may be impossible to eliminate a generation of the gloss memory. However, since malfunction such as paper-passing defect is not generated in this moment, there may be a case where a user cannot immediately check that the braking force generation portion is broken down. In such a case, the user realizes that the gloss memory occurs just after, for example, the image forming process is performed on a large number of the sheets of paper, which fails to address the issues on the image failure completely. Further, the image forming apparatuses disclosed in the above patent publications do not disclose any correspondence to any case where the braking force generation portion is broken down.

Means for Solving the Problem

This invention addresses the above-mentioned issues and has an object to provide an image forming apparatus that can early check that the braking force generation portion is broken down when eliminating the gloss memory.

To achieve the above-mentioned the object, an image forming apparatus reflecting one aspect of this invention contains a first fixing member that rotates, a second fixing member that rotates and conveys a sheet of paper on which a toner image has been formed while the second fixing member is clamped to the first fixing member, a driving portion that drives and rotates the first or second fixing member, a torque detection portion that detects a torque of the driving portion, a braking force generation portion that generates a braking force to a direction of obstructing rotation of the first or second fixing member, and a control portion configured to adjust the braking force generated by the braking force generation portion, wherein the control portion is configured to obtain a difference value between a torque value detected by the torque detection portion when the first and second fixing members are clamped and the braking force generation portion does not generate the braking force and a torque value detected by the torque detection portion when the first and second fixing members are clamped and the braking force generation portion generates the braking force and to determine whether or not the braking force generation portion is broken down on the basis of the comparison result of the obtained difference value and a predetermined threshold value.

It is desirable to provide the image forming apparatus wherein before it is determined whether or not the braking force generation portion is broken down, the control portion is configured to obtain a difference value between a torque value detected by the torque detection portion when the first and second fixing members are not clamped and the braking force generation portion does not generate the braking force and a torque value detected by the torque detection portion when the first and second fixing members are clamped and the braking force generation portion does not generate the braking force and to determine whether or not the torque detection portion is broken down on the basis of the comparison result of the obtained difference value and a predetermined threshold value.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

BRIEF DESCRIPTION OF THE DRAWINGS

FIG. 4 is a flowchart showing an operation example of the image forming apparatus when performing a fixing process.

DESCRIPTION OF THE PREFERRED EMBODIMENTS

The following will describe configuration examples of the image forming apparatus as preferred embodiments relating to the invention with reference to drawings. It is to be noted that the description in the embodiments is exemplified and any technical scope of the claims and/or meaning of term(s) claimed in the claims are not limited thereto.

[Configuration Example of Image Forming Apparatus]

Figure 1:
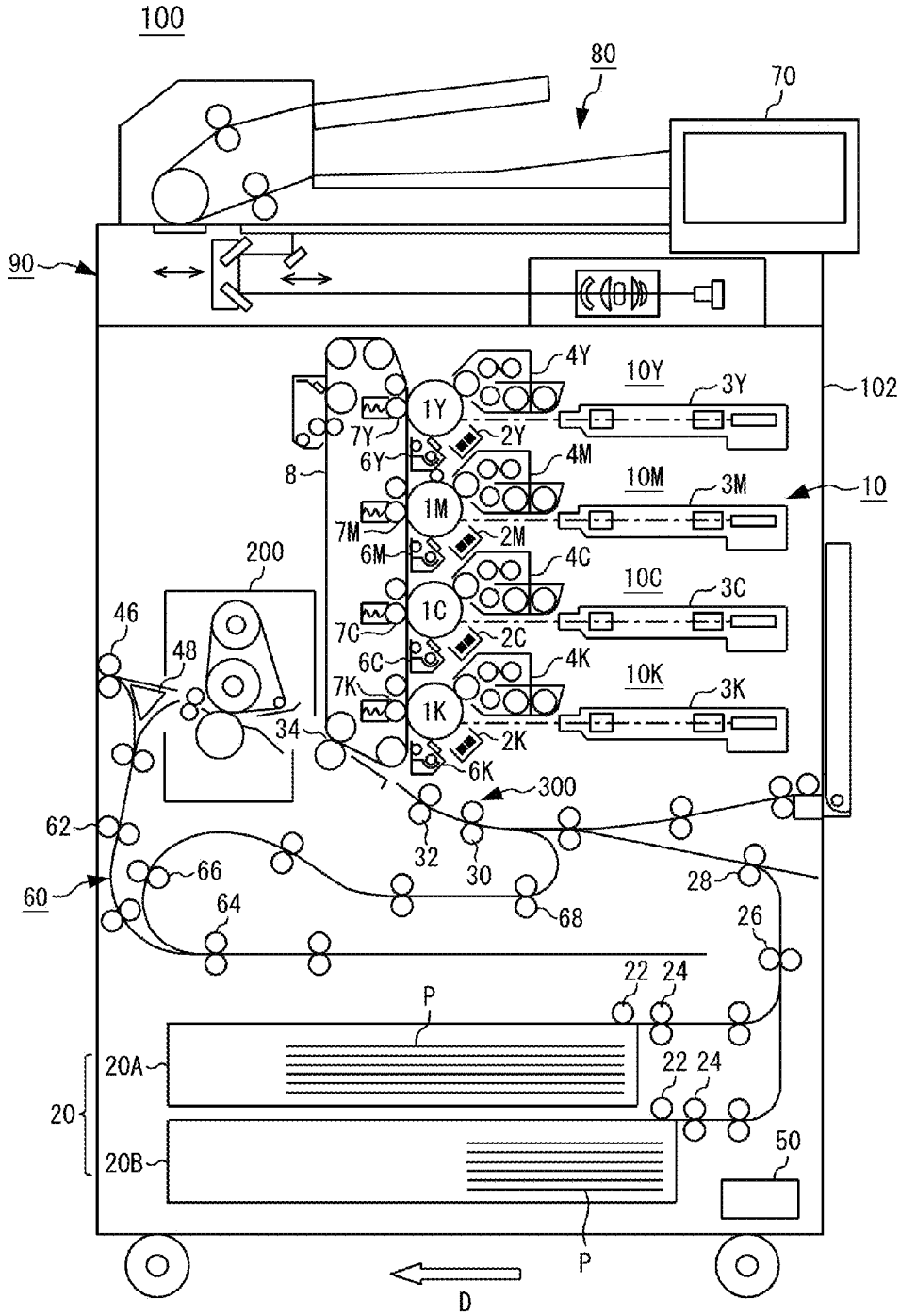
FIG. 1 is a diagram showing a configuration example of an image forming apparatus according to an embodiment of this invention.

The following will describe an image forming apparatus 100 according to an embodiment of the invention. FIG. 1 shows a configuration example of the image forming apparatus 100. It is to be noted that ratios and dimensions in drawings are shown in an exaggerated way for convenience of explanation and the ratios may be different from real ones.

As shown in FIG. 1, the image forming apparatus 100 is an image forming apparatus called as "tandem type image forming apparatus". The image forming apparatus 100 contains an automatic document feeding portion 80 and an apparatus main body 102. The apparatus main body 102 mounts the automatic document feeding portion 80. The automatic document feeding portion 80 feeds sheets of paper set on a document table to an image reading portion 90 of the apparatus main body 102 using conveying rollers and the like.

The apparatus main body 102 contains a manipulation/display portion 70, the image reading portion 90, an image forming portion 10, an intermediate transfer belt 8, a feeder 20, a register unit 300, a fixing portion 200, an auto duplex unit (ADU) 60 and a communication portion 50.

The manipulation/display portion 70 contains a touch panel in which a manipulation part and a display unit are combined, and various kinds of operation keys such as ten keys, a start key and the like. The manipulation/display portion 70 displays a manipulation (input) screen for setting of image forming conditions such as a size and/or a species of a sheet of paper input by a user through the manipulation screen and receives positional information selected by the input screen and/or operation keys.

The image reading portion 90 scans and exposes the document mounted on the document table or the document fed by the automatic document feeding portion 80 using an optical system in a scanning and exposure device. The image reading portion 90 also performs photoelectric conversion on a scanned image of the document by a charge-couple device (CCD) image sensor to obtain an image information signal. The image processing portion, not shown, then performs a predetermined processing such as an analog processing, analog-to-digital (A/D) conversion processing, a shade correction, image compression processing and the like on this image information signal and outputs it to the image forming portion 10.

The image forming portion 10 forms an image based on an electrophotographic method. The image forming portion 10 includes an image forming unit 10Y which forms a yellow (Y) image, an image forming unit 10M which forms a magenta (M) image, an image forming unit 10C which forms a cyan (C) image and an image forming unit 10K which forms a black (K) image. In this embodiment, in order to indicate a color relative to common function or name, Y, M, C or K will be attached to the number of the common function or name, for example, 10Y, 10M, 10C and 10K.

The image forming unit 10Y includes a photosensitive drum 1Y, a charging portion 2Y arranged around the photosensitive drum 1Y, a writing (exposure) portion 3Y, a developing portion 4Y and a cleaning portion 6Y. The image forming unit 10M includes a photosensitive drum 1M, a charging portion 2M arranged around the photosensitive drum 1M, an exposure portion 3M, a developing portion 4M and a cleaning portion 6M. The image forming unit 10C includes a photosensitive drum 1C, a charging portion 2C arranged around the photosensitive drum 1C, an exposure portion 3C, a developing portion 4C and a cleaning portion 6C. The image forming unit 10K includes a photosensitive drum 1K, a charging portion 2K arranged around the photosensitive drum 1K, an exposure portion 3K, a developing portion 4K and a cleaning portion 6K.

The respective photosensitive drums (image carriers) 1Y, 1M, 1C and 1K, the respective charging portions 2Y, 2M, 2C and 2K, the respective exposure portions 3Y, 3M, 3C and 3K, the respective developing portions 4Y, 4M, 4C and 4K, and the respective cleaning portions 6Y, 6M, 6C and 6K of the image forming units 10Y, 10M, 10C and 10K have the same configuration as each other. They will be indicated in the following description with Y, M, C and K being omitted except for a case in which any distinction thereof is required.

Each of the charging portions 2 uniformly charges static charges around a surface of each of the photosensitive drums 1. Each of the exposure portions 3 contains LED print head (LPH) including LED array and an image formation lens, and a laser scanning and exposure apparatus with polygon mirror system. Each of the exposure portions 3 scans each of the photosensitive drums 1 by laser light based on the image information signal to form electrostatic latent images on each of the photosensitive drums 1. Each of the developing portions 4 develops the electrostatic latent images formed on each of the photosensitive drums 1 using toners. Thus, a toner image that is visible image is formed on each of the photosensitive drums 1.

The intermediate transfer belt 8 is an endless belt. The intermediate transfer belt 8 runs on plural rollers with it being stretched and supported by them. Together with the rotation of the intermediate transfer belt 8, each of the primary transfer rollers 7 and each of the photosensitive drums 1 rotate. When applying a predetermined electric voltage between each of the primary transfer rollers 7 and each of the photosensitive drums 1, the toner image formed on each of the photosensitive drums 1 is transferred on the intermediate transfer belt 8 (Primary Transfer).

The feeder 20 has plural feeding trays 20A, 20B each containing sheets of paper with a size such as A3, A4 or the like. The feeder 20 feeds the sheets of paper P one by one from the selected feeding tray and conveys the fed sheet of paper P to the register unit 300 through conveying rollers 22, 24, 26 and 28 and the like. It is to be noted that numbers of the feeding trays are not limited to two. A single or plural large capacity sheet feeder(s), which can contain a large number of sheets of paper P, may connect the image forming apparatus depending on the situation.

The register unit 300 includes a pair of loop-forming rollers 30 and a pair of registration rollers 32. The pair of loop-forming rollers 30 hits a forward end of the sheet of paper P conveyed by the register unit 300 to the pair of registration rollers 32 to form a loop so that a skew (inclination) of the sheet of paper P in relation to a sheet-feeding direction D of the sheet of paper P. The pair of registration rollers 32 conveys the sheet of paper P, the skew of which is corrected, to secondary transfer rollers 34 at desired timing. The secondary transfer rollers 34 transfer toner images of colors Y, M, C and K formed on the intermediate belt 8 altogether to a surface of the sheet of paper P fed by the pair of registration rollers 32 (Secondary Transfer). The secondary transfer rollers 34 then conveys the sheet of paper P on which the secondary transfer is formed to the fixing portion 200 that is arranged at a downstream side along the sheet-feeding direction D of the sheet of paper P.

The fixing portion 200 fixes the toner images transferred on the surface of the sheet of paper P to the sheet of paper P by applying pressure to the sheet of paper P to which the toner images are transferred by the secondary transfer rollers 34 and heating the same.

A conveying path changeover portion 48 for changing over the conveying path of the sheet of paper P to a sheet ejection side or a side of ADU 60 is provided at a downstream side of the fixing portion 200 along the sheet-feeding direction D. The conveying path changeover portion 48 performs changeover control of the conveying path based on a selected printing mode (single surface printing mode or duplex printing mode).

Ejection rollers 46 eject onto a sheet-ejection tray, not shown, the sheet of paper P, a single surface of which has been printed in the single surface printing mode or both surfaces of which have been printed in the duplex printing mode.

When re-feeding the sheet of paper P, a surface side of which has been printed, to the image forming portion 10 during the duplex printing mode, the sheet of paper P is conveyed to ADU 60 via the conveying path changeover portion 48. The conveying rollers 62 and the like convey the sheet of paper, which is conveyed to the ADU 60, to a switchback route. In the switchback route, ADU rollers 64 perform a reverse rotation control on the sheet of paper P to convey the sheet of paper P to a U-turn path with a rear end of the sheet of paper P being lead. The conveying rollers 66, 68 and the like provided in the U-turn path re-feed the sheet of paper P to the pair of registration rollers 32 while front and back of the sheet of paper P is reversed. The sheet of paper P re-fed to the pair of registration rollers 32 is subject to any image forming processing which is similar to the image forming processing that has been carried out in the front surface side of the sheet of paper P. The secondary transfer rollers 34 transfers toner images on the back surface of re-fed sheet of paper P and the fixing portion 200 fixes them. The ejection rollers 46 then eject onto the sheet-ejection tray, the duplex-printed sheet of paper P through the conveying path changeover portion 48.

The communication portion 50 is composed of, for example, a communication control card such as a local area network (LAN) card. The communication portion 50 communicates various kinds of data such as image data to an outside device (for example, a personal computer) which is connected to the communication portion 50 via a communication network such as LAN or a wide area network (WAN).

[Configuration Example of Fixing Portion]

Figure 2:
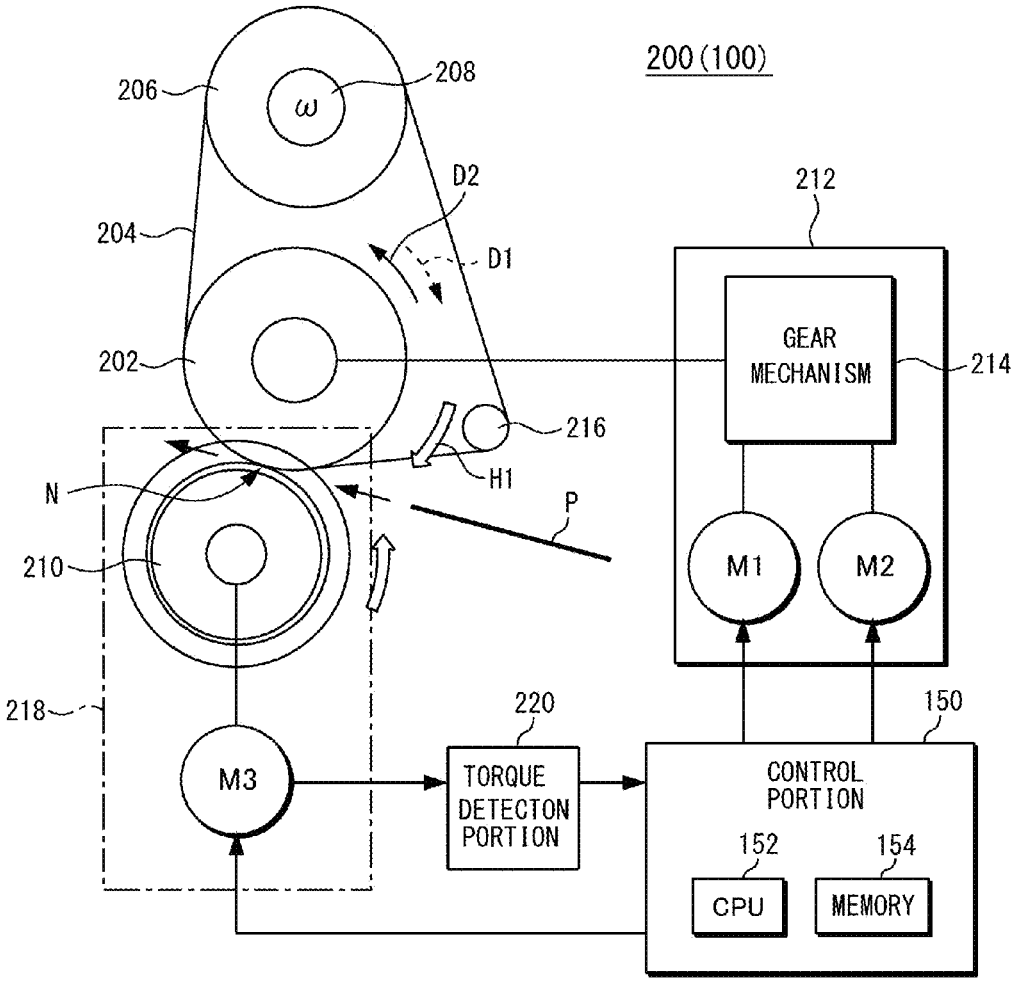
FIG. 2 is a diagram showing a configuration example of a fixing device.

The following will describe a configuration example of the fixing portion 200. FIG. 2 shows a configuration example of the fixing portion 200 including function blocks therein. The configuration of the fixing portion 200 will be first described. The fixing portion 200 according to this embodiment is, for example, a fixing portion of heating belt system. The fixing portion 200 includes a pressuring part that constitutes a fixing nip portion N for conveying the sheet of paper P with it being nipped, and a heating part for contacting the sheet of paper P on which the toner image has been transferred, and heating it at the fixing temperature.

As shown in FIG. 2, the fixing portion 200 contains an upper pressuring roller 202, a fixing belt 204, a heating roller 206, a stretch roller 216, a lower pressuring roller 210 and a changeover mechanism 218. It is to be noted that the upper pressuring roller 202, the fixing belt 204 and the heating roller 206 constitute a first fixing member and the lower pressuring roller 210 constitutes a second fixing member.

The upper pressuring roller 202 contains a cylindrical mandrel made of, for example, steel and an elastic layer made of silicone rubber, which is formed on a circumference of the mandrel. The upper pressuring roller 202 may be configured so that a surface release layer made of fluorine-based resin is formed on a circumference of the elastic layer. The upper pressuring roller 202 contacts the lower pressuring roller 210, which is rotationally driven, with pressure through the fixing belt 204 and rotates together with the fixing belt 204 following the rotation of the lower pressuring roller 210.

The heating roller 206 contains a cylindrical mandrel made of, for example, aluminum and a resin layer made of polytetrafluoroethylene (PTFE), which is formed on a circumference of the mandrel. The heating roller 206 has a heating source 208 such as halogen heater built-in. The heating source 208 heats the mandrel and the resin layer so that this heated resin layer and the like heat the fixing belt 204.

The fixing belt 204 is an endless belt which is stretched by the upper pressuring roller 202, the heating roller 206 and the stretch roller 216. For example, the fixing belt 204 contains a heat-resistant polyimide film base, an elastic layer made of silicone rubber and a surface release layer made of fluorine-based resin and is configured so that they are laminated in this order. The fixing belt 204 acts as the heating part that contacts the sheet of paper P on which the toner image has been transferred, and heats this sheet of paper P at a predetermined temperature. As the fluorine-based resin, a material which contains any one of perfluoroalkoxy alkane (PFA), PTFE and fluorinated ethylene-propylene copolymer (FEP) may be used. This allows a release quality of a surface of the fixing belt 204 from the wax contained in the toner resin and toner particles to be improved, so that the toner is hard to adhere to the surface of the fixing belt 204 when performing the fixing process.

The stretch roller 216 is a roller, both ends of which are rotatably supported, and functions to adjust tension of the fixing belt 204. The stretch roller 216 may suitably adjust the tension of the fixing belt 204 by arranging the stretch roller 216 so as to be movable.

The lower pressuring roller 210 contains a cylindrical mandrel made of, for example, steel and an elastic layer made of silicone rubber, which is formed on a circumference of the mandrel. The lower pressuring roller 210 may be configured so that a surface release layer made of fluorine-based resin is formed on a circumference of the elastic layer. The lower pressuring roller 210 rotates with it contacting the fixing belt 204 with pressure and functions as the pressuring part.

The changeover mechanism 218 contains a biasing member for adjusting any biasing force of the lower pressuring roller 210 against the upper pressuring roller 202 and allows the lower pressuring roller 210 to push against the upper pressuring roller 202, or to be released from the upper pressuring roller 202, by adjusting the biasing member. A control portion 150 controls operation of the changeover mechanism 218, which will be described later.

Such a configuration allows the fixing nip portion N to be formed when performing the fixing process by pushing the rotating lower pressuring roller 210 against the circumference of the fixing belt 204. When passing the sheet of paper P on which the toner image has been transferred through this fixing nip portion N, the fixing portion 200 performs the fixing process on the sheet of paper P by the heating process and the pressuring process.

[Configuration Example of Blocks in Fixing Portion]

The following will describe a configuration example of the blocks in the fixing portion 200 according to the embodiment of the invention with reference to FIG. 2. As shown in FIG. 2, the fixing portion 200 contains a control portion 150, a driving motor (driving portion) M3, a torque generation portion 212 as a braking force generation portion, and a torque detection portion 220.

The control portion 150 controls operations of the whole image forming apparatus 100 including those of the fixing portion 200. The control portion 150 includes a central processing unit (CPU) 152 and a memory 154. The CPU 152 carries out software (programs) read out of the memory 154 to control each portion of the image forming apparatus 100 and carries out a normal image forming operation mode including the fixing control according to the invention.

Further, during the fixing control, the control portion 150 carries out a serviceman call (SC) detection mode in which it is detected whether or not the torque detection portion 220 is broken down and/or whether or not the braking motor M1 is broken down. A user can set the execution of the SC detection mode and detailed selection items therefor on the manipulation screen of the manipulation/display portion 70 at his option. The control portion 150 can perform the SC detection mode before a job start, during a period of idling time (after a job finish) while no image forming process is performed, during power up (warning up time) of the image forming apparatus 100, or for every predetermined number of sheets of printed paper.

The memory 153 may be constituted of, for example, read only memory (ROM), random access memory (RAM), hard disk drive (HDD) and the like. The memory 154 stores a threshold value used for determining whether or not the torque detection portion 220 is broken down, a threshold value used for determining whether or not the braking motor M1 is broken down, data showing correlation between a driving current value to the driving motor M3 and a rotation torque of the driving motor M3, and the like.

The driving motor M3 is constituted of, for example, a stepping motor and drives to rotate the lower pressuring roller 210 based on a driving signal received from the control portion 150. The upper pressuring roller 202 and the fixing belt 204 rotate following the rotation of this lower pressuring roller 210.

The torque generation portion 212 generates braking force to a direction of obstructing rotation of the fixing belt 204 in order to set a difference between a surface speed of the fixing belt 204 and a surface speed of the lower pressuring roller 210. The torque generation portion 212 contains a braking motor M1, an assisting motor M2 and a gear mechanism 214. It is to be noted that the braking motor M1 constitutes braking member, and the assisting motor M2 constitutes assisting member.

The braking motor M1 reversely rotates against the rotation of the upper pressuring roller 202 which rotates along a conveying direction H1 (hereinafter, referred to as "normal rotation") based on a control signal received from the control portion 150 and applies a torque to the upper pressuring roller 202 to generate brake force D2 to the upper pressuring roller 202 that normally rotates. The brake force D2 enables the sheet of paper P and the fixing belt 204 to be slipped and prevents the gloss memory.

The assisting motor M2 rotates to the same direction as the normal rotation of the upper pressuring roller 202 based on a control signal received from the control portion 150 and applies a torque for assisting the normal rotation of the upper pressuring roller 202 to the upper pressuring roller 202 which normally rotates along the conveying direction H1 to generate assisting force D1 for rotating the upper pressuring roller 202 along the conveying direction H1.

The gear mechanism 214 contains plural gear trains for transmitting respective rotations of the braking motor M1 and the assisting motor M2 to the upper pressuring roller 202 separately. The torques of both of the braking motor M1 and the assisting motor M2 are transmitted to the upper pressuring roller 202 via these gear trains while they are combined.

The torque detection portion 220 detects a rotation torque of the driving motor M3 from a value of driving current supplied to the driving motor M3 following programs stored in the memory 154 and supplies the detected rotation torque of the driving motor M3 to the control portion 150.

[Description of Braking Force]

Figure 3:
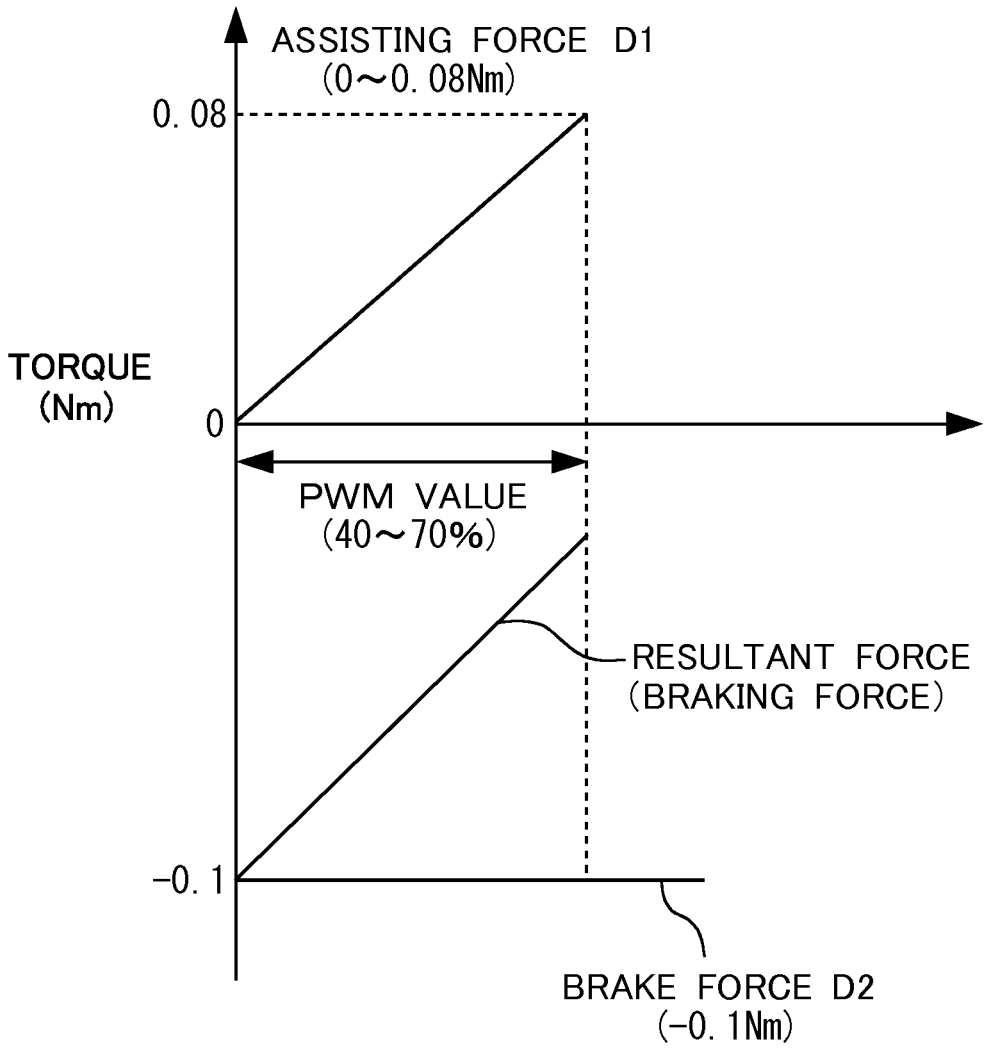
FIG. 3 is a graph showing a braking force generated by a braking force generation portion.

The following will describe the braking force generated by the torque generation portion 212 with reference to FIG. 3. The torque (brake force D2) generated by the braking motor M1 is constant as shown in FIG. 3. Specifically, it is −0.1 Nm. On the other hand, since the control portion 150 controls the assisting motor M2 by pulse width modulation (PWM) to generate the torque (assisting force D1), the torque (assisting force D1) varies, which is within a range of 0 Nm to 0.08 Nm (PWM value of 40% through 70%).

Thus, the assisting force D1 is set so as to be within the range of the brake force D2 (namely, it is a smaller value than an absolute value of the brake force D2. Accordingly, resultant force of both of the assisting force D1 and the brake force D2 also varies. This resultant force is the above-mentioned braking force which enables a surface speed (circumferential speed) of the upper pressuring roller 202 to become slower by 0.3% through 0.8% than a surface speed (circumferential speed) of the lower pressuring roller 210. As a result thereof, a slip occurs between the fixing belt 204 and the sheet of paper P.

[Operation Example of Image Forming Apparatus]

The following will describe an operation example of the image forming apparatus 100 according to the embodiment of this invention. FIG. 4 shows the operation example of the image forming apparatus 100 during the SC detection mode. The following will describe a case where the SC detection mode is performed during a period of idling time.

As shown in FIG. 4, at a step S100, after a predetermined input job is finished, the image forming apparatus 100 shifts the image forming processing to idling state when no image forming process is performed. At a step S110, when the control portion 150 determines that the image forming apparatus 100 stays in the idling state, the control portion 150 performs the SC detection mode. In the SC detection mode, the control portion 150 first determines whether or not the torque detection portion 220 is broken down (whether or not the torque detection portion 220 operates normally).

At a step S120, the control portion 150 controls the driving motor M3 to rotate the lower pressuring roller 210 at 2000 rpm and controls the assisting motor M2 to rotate at PWM 20%. The control portion 150 also controls the operation of change-over mechanism 218 to switch the braking motor M1 off not to generate any braking force and not to clamp the lower pressuring roller 210 to the upper pressuring roller 202 (to release the lower pressuring roller 210 from the upper pressuring roller 202). In this embodiment, these fixing conditions during the SC detection mode are referred to as "fixing conditions A".

At a step S130, the torque detection portion 220 detects a torque value X Nm of the driving motor M3 at the fixing conditions A. The control portion 150 acquires the torque value X of the driving motor M3, which is detected by the torque detection portion 220, and controls the memory 154 to store the obtained torque value X therein.

At a step S140, the control portion 150 controls the driving motor M3 to rotate the lower pressuring roller 210 at 2000 rpm and controls the assisting motor M2 to rotate at PWM 20%. The control portion 150 also controls the operation of change-over mechanism 218 to switch the braking motor M1 off not to generate any braking force and to clamp the lower pressuring roller 210 to the upper pressuring roller 202 (to contact the lower pressuring roller 210 to the upper pressuring roller 202 with pressure). In this embodiment, these fixing conditions during the SC detection mode are referred to as "fixing conditions B".

At a step S150, the torque detection portion 220 detects a torque value Y Nm of the driving motor M3 at the fixing conditions B. The control portion 150 acquires the torque value Y of the driving motor M3, which is detected by the torque detection portion 220, and controls the memory 154 to store the obtained torque value Y therein. Here, since a load applied to the driving motor M3 becomes larger by clamping the lower pressuring roller 210 to the upper pressuring roller 202, the torque value Y becomes larger than the torque value X in a case where the torque detection portion 220 is a normal condition where it is not broken down.

At a step S160, the control portion 150 determines whether or not the torque detection portion 220 is broken down. Specifically, the control portion 150 reads out of the memory 154 the torque value X obtained in the fixing conditions A and the torque value Y obtained in the fixing conditions B. The control portion 150 then subtracts the torque value X from the torque value Y to obtain a difference value to determine whether or not the obtained different value exceeds a predetermined threshold value. For example, supposing that the torque detection portion 220 is normal, the threshold value is set. In this embodiment, for example, the threshold value is set to be 0.06 Nm.

If it is determined that the different value exceeds the predetermined threshold value, the control portion 150 determines that the torque detection portion 220 is not broken down, namely, the torque detection portion 220 is normal and goes to a step S170. From the step S170 on, it will be determined whether or not the braking motor M1 is broken down.

If the control portion 150 determines that the difference value is does not exceed the predetermined threshold value, the control portion 150 determines that the torque detection portion 220 is broken down and goes to a step S220. As causes of breaking down the torque detection portion 220, contact failure of the connector and the like are exemplified. At the step S220, the control portion 150 controls the manipulation/display portion 70 to display on its screen a massage such as "the torque detection portion is broken down" (serviceman call).

Even when it is determined that the difference value does not exceed the predetermined threshold value, there may be a possibility where a torque value to be supposed at clamping is not output by not normally clamping the upper pressuring roller 202 to the lower pressuring roller 210 so that the torque value does not exceed the threshold value. Accordingly, the control portion 150 controls the manipulation/display portion 70 to display on its screen a massage such as "The torque detection portion is broken down" and "There is a clamping error between the upper pressuring roller 202 and the lower pressuring roller 210". In addition, when a sensor for detecting that there is a clamping error is arranged, the control portion 150 can display warning message only when the clamping error is generated.

On the other hand, if it is determined that the difference value exceeds the previously set threshold value, at the step S170, the control portion 150 determines whether or not the braking motor M1 is broken down. Specifically, the control portion 150 controls the driving motor M3 to rotate the lower pressuring roller 210 at 2000 rpm and controls the assisting motor M2 to rotate at PWM 20%. The control portion 150 also controls the operation of change-over mechanism 218 to switch the braking motor M1 on to generate any braking force and to clamp the lower pressuring roller 210 to the upper pressuring roller 202. This enables any braking force (based on brake force D2) to a reverse direction of the normal rotation direction to be applied to the lower pressuring roller 210 which is clamped with the upper pressuring roller 202 and rotates normally. In this embodiment, these fixing conditions during the SC detection mode are referred to as "fixing conditions C".

At a step S180, the torque detection portion 220 detects a torque value Z Nm of the driving motor M3 at the fixing conditions C. The control portion 150 acquires the torque value Z of the driving motor M3, which is detected by the torque detection portion 220, and controls the memory 154 to store the obtained torque value Z therein. Here, since a load applied to the driving motor M3 becomes larger by applying the brake force D2 by the braking motor D1, the torque value Z becomes larger than the torque value Y when the braking motor M1 is a normal condition where it is not broken down.

At a step S190, the control portion 150 determines whether or not the braking motor M1 is broken down. Specifically, the control portion 150 reads out of the memory 154 the torque value Y obtained in the fixing conditions B and the torque value Z obtained in the fixing conditions C, respectively. The control portion 150 then subtracts the torque value Y from the torque value Z to obtain a difference value to determine whether or not the obtained different value exceeds a predetermined threshold value. For example, supposing that the braking motor M1 is normal, the threshold value is set. In this embodiment, for example, the threshold value is set to be 0.05 Nm.

If it is determined that the different value exceeds the predetermined threshold value, the control portion 150 determines that the braking motor M1 is not broken down, namely, the braking motor M1 is normal and goes to a step S200. At the step S200, if it is confirmed that both of the braking motor M1 and the torque detection portion 220 are not broken down, the control portion 150 finishes the SC detection mode.

On the other hand, if it is determined that the difference value does not exceed the predetermined threshold value, the control portion 150 goes to a step S210. As causes of breaking down the braking motor M1, contact failure of the connector and the like are exemplified. At the step S210, the control portion 150 controls the manipulation/display portion 70 to display on its screen a massage such as "the braking motor is broken down" (serviceman call). Further, if it is determined that the difference value does not exceed the predetermined threshold value, there may be a possibility where a torque value to be supposed at clamping is not output by not normally clamping the upper pressuring roller 202 to the lower pressuring roller 210 so that the torque value does not exceed the threshold value. Accordingly, the control portion 150 controls the manipulation/display portion 70 to display on its screen a massage such as "The braking motor is broken down" and "There is a clamping error between the upper pressuring roller 202 and the lower pressuring roller 210". In addition, when a sensor for detecting that there is a clamping error is arranged, the control portion 150 can display warning message only when the clamping error is generated.

As described above, according to the embodiment, during a period of idling time in the image forming apparatus 100, the image forming apparatus 100 performs the SC detection mode in which it is determined whether or not the braking motor M1 or the torque detection portion 220 is broken down. Therefore, before many sheets of paper are printed and a malfunction occurs in an image quality thereof, it is possible to confirm any abnormal in the braking motor M1 or the torque detection portion 220. This enables the braking motor M1 or the torque detection portion 220 to be repaired and/or exchanged at early stage so that many image defects can be avoided. As a result thereof, it is possible to suppress rise in costs of the sheet of paper P and/or toner and to prevent productivity from decreasing.

Further, in the embodiment, since it is determined whether or not the torque detection portion 220 is broken down before it is determined whether or not the braking motor M1 is broken down, it is possible to determine whether or not the braking motor M1 is broken down on the assumption that the torque detection is normal. Therefore, it is possible to surely and accurately determine whether or not the braking motor M1 is broken down.

According to the embodiment, it is possible to avoid applying a torque too much to the driving motor M3 without taking notice of any failure in the braking motor M1 and/or the torque detection portion 220 so that it is possible to suppress rise in temperature or the like.

It should be understood by those skilled in the art that various modifications, combinations, sub-combinations and alterations may occur depending on design requirements and other factors insofar as they are within the scope of the appended claims or the equivalents thereof.

Although it has described in the above-mentioned embodiment that the fixing portion 200 is configured to be the heating belt system, this invention is not limited thereto. For example, the fixing portion, which is configured to be the heating roller system without using any fixing belt 204, may be applied to this invention. In the fixing portion 200, the lower pressuring roller 210 may have the heating source 208 such as halogen heater built-in. The fixing belt 204 may be configured to be heated by induction heating (IH). It is possible to configure such that the driving motor is arranged at a side of the upper pressuring roller 201 and the torque detection portion 212 is arranged at a side of the lower pressuring roller 210.

The invention claimed is:

1. An image forming apparatus comprising:

a first fixing member that rotates;

a second fixing member that rotates and conveys a sheet of paper on which a toner image has been formed while the second fixing member is clamped to the first fixing member;

a driving portion that drives and rotates the first or second fixing member;

a torque detection portion that detects a torque of the driving portion;

a braking force generation portion that generates a braking force to a direction of obstructing rotation of the first or second fixing member; and a control portion configured to adjust the braking force generated by the braking force generation portion, wherein the control portion is configured to obtain a difference value between a torque value detected by the torque detection portion when the first and second fixing members are clamped and the braking force generation portion does not generate the braking force and a torque value detected by the torque detection portion when the first and second fixing members are clamped and the braking force generation portion generates the braking force and to determine whether or not the braking force generation portion is broken down on the basis of the comparison result of the obtained difference value and a predetermined threshold value, wherein before it is determined whether or not the braking force generation portion is broken down, the control portion is configured to obtain a difference value between a torque value detected by the torque detection portion when the first and second fixing members are not clamped and the braking force generation portion does not generate the braking force and a torque value detected by the torque detection portion when the first and second fixing members are clamped and the braking force generation portion does not generate the braking force and to determine whether or not the torque detection portion is broken down on the basis of the comparison result of the obtained difference value and a predetermined threshold value.

2. The image forming apparatus according to claim 1 wherein the control portion is configured to determine whether or not the torque detection portion is broken down before a start of a job, a finish of the job or a time of power up.

3. The image forming apparatus according to claim 1 wherein the braking force generation portion comprises:

a braking member that generates a braking force to a direction of obstructing rotation of the first or second fixing member; and an assisting member that generates an assisting force which is applied to an opposite direction of the braking force by the braking member within a range of the braking force generated by the braking member wherein the control portion is configured to adjust the braking force by setting the braking force generated by the braking member to be constant and setting the assisting force generated by the assisting member to vary.

4. An image forming apparatus comprising:

a first fixing member that rotates;

a second fixing member that rotates and conveys a sheet of paper on which a toner image has been formed while the second fixing member is clamped to the first fixing member;

a driving portion that drives and rotates the first or second fixing member;

a torque detection portion that detects a torque of the driving portion;

a braking force generation portion that generates a braking force to a direction of obstructing rotation of the first or second fixing member; and a control portion configured to adjust the braking force generated by the braking force generation portion, wherein the control portion is configured to obtain a difference value between a torque value detected by the torque detection portion when the first and second fixing members are clamped and the braking force generation portion does not generate the braking force and a torque value detected by the torque detection portion when the first and second fixing members are clamped and the braking force generation portion generates the braking force and to determine whether or not the braking force generation portion is broken down on the basis of the comparison result of the obtained difference value and a predetermined threshold value, wherein the control portion is configured to determine whether or not the braking force generation portion is broken down before a start of a job, a finish of the job or a time of power up.

5. The image forming apparatus according to claim 4 wherein the braking force generation portion comprises:

a braking member that generates a braking force to a direction of obstructing rotation of the first or second fixing member; and an assisting member that generates an assisting force which is applied to an opposite direction of the braking force by the braking member within a range of the braking force generated by the braking member wherein the control portion is configured to adjust the braking force by setting the braking force generated by the braking member to be constant and setting the assisting force generated by the assisting member to vary.

* * * * *